United States Patent [19]

Pocci

[11] Patent Number: 4,790,602

[45] Date of Patent: Dec. 13, 1988

[54] FLUID ACTUATED APPARATUS FOR MECHANICALLY SPLITTING ROCK-LIKE MATERIAL

[76] Inventor: Silvano Pocci, Eric Dr., Kinnelon, N.J. 07405

[21] Appl. No.: 98,917

[22] Filed: Sep. 21, 1987

[51] Int. Cl.[4] ..... E21C 37/04

[52] U.S. Cl. ..... 299/21; 299/23

[58] Field of Search ..... 299/20–23; 166/177; 144/193 D; 254/104

[56] References Cited

U.S. PATENT DOCUMENTS

| | | | |
|---|---|---|---|
| 1,008,818 | 11/1911 | Harris | 299/23 |
| 1,034,860 | 8/1912 | Ballou | 299/23 |
| 3,791,698 | 2/1974 | Darda | 299/23 |
| 3,894,772 | 7/1975 | Darda | 299/22 |

*Primary Examiner*—Jerome W. Massie, IV
*Assistant Examiner*—Matthew Smith
*Attorney, Agent, or Firm*—Alfred C. Hill

[57] ABSTRACT

Apparatus to break rock and concrete slabs in situ when inserted into a predrilled hole in the rock and concrete slabs comprises first and second members each having an outer surface parallel to each other and the wall of the predrilled hole; a third member having a driven end, a free end, a first surface parallel to the outer surface of the first and second members slidably engaging a bottom surface of a longitudinal groove in the first member coextensive therewith and second surface opposite the first surface having a first predetermined slope along a given length of the third member from a point adjacent to the drive end to the free end, the third member having a single inward stroke of a predetermined length during each cycle of operation; and a first arrangement disposed between the second surface of the third member and an inner surface of the second member, the first arrangement when rendered operative causing the outer surface of the first and second members to engage the wall of the predetermined hole and responding to the inward stroke of the third member to apply a powerful breaking force directly to the second member resulting in lateral movement thereof and to apply a reaction force equal to the breaking force to the first member to break the rock and concrete slab surrounding the predrilled hole.

20 Claims, 3 Drawing Sheets

FLUID ACTUATED APPARATUS FOR MECHANICALLY SPLITTING ROCK-LIKE MATERIAL

BACKGROUND OF THE INVENTION

The present invention relates to the breaking of rock and concrete slabs in situ into pieces small enough to be removed by conventional earth moving equipment and more particularly to an improved apparatus to accomplish the same.

In the past, large rocks were split or cracked by the use of dynamite. This same technique can be employed with concrete slabs. When dynamite was used, it was necessary to drill bore holes in the rock into which a stick of dynamite was placed. An electric cap is attached to the stick of dynamite with the wires feeding therefrom connected in a circuit containing a switch and a source of electricity.

One of the drawbacks to using dynamite to split or crack large rocks and concrete slabs is the danger factor. If the blasting operation is to be performed in an area having buildings or homes in close proximity, it is necessary to cover the rock with a blasting mat to prevent propulsion of pieces of rock through the air in an uncontrolled manner. Special risks are created where the blasting operation takes place near gas lines. Also if dynamite is being used a special magazine is needed to store or carry the dynamite to the job site. The resulting danger necessitates the obtaining of special permits to perform the blasting operations and also necessitates costly liability insurance. Liability insurance premiums are a prime factor in the high cost of conventional explosive use.

A further drawback to the use of dynamite to split large rocks and concrete slabs in an area having buildings or homes in close proximity is due to the shock waves generated which travel along the rock ledge which can produce cracks in foundations of nearby buildings or homes, can crack well casings of on site artesian wells and can crack on site or individually maintained septic systems. Thus, the buildings or homes can be damaged and the artesian well can be polluted by cracks developed in the well casing and in the on site septic system.

Another drawback to the use of dynamite to split large rocks and concrete slabs is that it requires a trained expert to set the charge and explode it. In many cases this necessitates the hiring of a blasting contractor and delays may result from his having to fit your job into his schedule. Also special time consuming procedures are normally observed to insure safety and one of these is the requirement of removing personnel and/or equipment to a safer place while the blasting operation takes place. This in general results in production down time since the general work of the labor force is normally curtailed while the blasting process takes place.

A further drawback to the use of dynamite as opposed to a machine or tool that will perform the same result is the cost fact. The blasting caps required as well as the dynamite itself required to provide a useful force is expensive. Once the blasting operation occurs, these materials are lost and cannot be used again. If a tool or machine is utilized to perform the operation, it can normally be used again and again.

An additional drawback to the use of explosives for cracking or splitting or large rocks and concrete slabs is the relatively long time required to perform the preparation work. The charge are normally set in holes which have been drilled approximately four feet deep into the rock. The time required for drilling the first two feet of the hole takes about four minutes. To perform the next two feet of drilling requires more than twice that amount of time. One reason for this is the loss of hammering power due to the dampening effect on the longer shaft. An additional factor is the loss of sufficient air volume and pressure to exhaust chips from the bottom of the hole resulting in loss of drilling efficiency due to the padding effect caused by the chips that are not removed quickly enough. When long drilling time of these holes is multiplied times the number of holes that will be drilled in cracking a large rock, the total time becomes very substantial.

A final drawback to the use of dynamite for splitting large rocks is the environmental aspect. The use of dynamite results in the release of poisonous gases into the air. It also results in dust being stirred up into the atmosphere.

Machines or tools to break rock and concrete slabs are known in the prior art. The prior art uses a wedge having two tapered surfaces which is driven between two feathers or pressure cheeks which can be inserted in predrilled holes and the pressure cheeks or feathers are laterally moved by the longitudinal movement of the two surfaced tapered wedge.

Nine U.S. patents to H. DARDA of Germany have employed a hydraulic cylinder to move a two surfaced tapered wedge between two held feathers. These patents include U.S. Pat. Nos. 3,414,328; 3,439,954; 3,488,093; 3,526,434; 3,791,698; 3,883,178; 3,894,772; 3,957,309 and 3,995,906. In addition, patents of note are U.S. Pat. No. 2,093,452 issued to JOY as well as U.S. Pat. Nos. 3,550,191 and 3,572,840 issued to FLETCHER and U.S. Pat. No. 4,114,951 issued to LANGFIELD et al.

One disadvantage of the above prior art is that the steel thrust or wear plate employed in these apparatus often cracks or breaks during or as a result of the thrust and splitting action movement of the two surfaced tapered wedge. These wear or thrust plates are retained by grooves and/or screws. Under this thrusting action and when and where dirt, rock or other material or factors reduce the ability of the wedge to slide along the face of the feathers an increase of pressure and a cracking or breaking of these wear plates results. Repeated actuation of the wedge to produce this splitting action often causes cracked or broken wear or thrust plates to cut or mutilate the housing or retainer, usually made of aluminum, to the extent that it is not satisfactorily useable.

All of the prior art known uses hydraulic or air pressure (fluid pressure) to power a mechanical device. Virtually all the prior art uses the same principle, namely, the transfer of longitudinal power through the mechanical advantage of a tapered wedge having two tapered surfaces to lateral power exterted upon the sides of predrilled holes in rock or concrete slabs.

The prior art apparatus is able to generate forces of less than one million pounds per square inch which is far below the forces needed to break granite and trap rock. As a result of this, the state of the art apparatus necessarily limits its use to the breaking of concrete slabs, softer rock and minerals.

A majority of the prior art apparatus uses wedges having a mechanical advantage of approximately 10 to 1. This prior art apparatus must do so for a number of reasons; (1) holes drilled in rock vary in the size of diameter of the drilled holes into which the feathers must fit, (2) when the holes are drilled they are not drilled straight and the feathers cannot be made long or breakage results.

Devices of the prior art can only increase power in one of three basic ways (1) increase power of the hydraulic ram by (a) increasing the pressure over 7,100 psi which is really not feasible, (b) increase the size of the hydraulic cylinder which results in a subsequent increase in bulk and unmanageability; (2) change the mechanical advantage over 10 to 1 by making the wedge thinner relative to length which increases the stroke length, or making the wedge longer which also increases the stroke length. With both of these remedies there is required a corresponding increase in the predrilled hole length. Most of the problems in the prior art occur because of the requirement of deep holes. To double the power to 20 to 1 mechanical advantage requires doubling the length of the hole that is predrilled in the rock.

In my copending application, Ser. No. 056,462, filed June 1, 1987, I disclose and claim a fluid actuated apparatus for mechanically splitting rock-like material which overcomes all of the disadvantages of breaking rock and concrete slabs using explosives as mentioned above and which provides a substantial improvement over the apparatus of the above-mentioned prior art apparatus. The apparatus of my above-mentioned copending application employs a power wedge having a predetermined slope on only one surface thereof which is reciprocated a predetermined number of times greater than one during each cycle of operation. This apparatus employs an arrangement to retain the rock and concrete slab breaking members in their lateral position after each inward stroke of the power wedge while the power wedge is withdrawn prior to its next inward stroke. Due to the slope of the power wedge and the cooperating configuration of all of the members of the apparatus of my above-mentioned copending application, the mechanical advantage is seven (7) times greater than that achieved by previously known prior art apparatus. This increase in mechanical advantage is achieved with apparatus which is smaller than the previously known prior art apparatus.

SUMMARY OF THE INVENTION

A first object of the present invention is to provide an apparatus for splitting large rocks and concrete slabs that will not throw debris or send massive uncontrolled shock waves throughout the surrounding area.

A second object of the present invention is to provide a device for splitting large rocks and concrete slabs that will eliminate use of dynamite with its attendant dangers.

A third object of the present invention is to provide an apparatus for splitting large rocks and concrete slabs that will not necessitate the movement of personnel and/or equipment to a safe place while the apparatus is in operation.

A fourth object of the present invention is to provide an apparatus for splitting large rocks and concrete slabs that would not disturb the surrounding area or loosen the walls of a ditch or tunnel in close proximity thereto thus exposing personnel to unnecessary cave-in hazards.

A fifth object of the present invention is to provide an apparatus for splitting large rocks and concrete slabs that does not require the person operating the apparatus to have extensive special knowledge, such as is required of an explosive expert.

A sixth object of the present invention is to provide an apparatus for splitting large rocks and concrete slabs that does not release any poisonous gas or throw any dust into the air.

A seventh object of the present invention is to provide an apparatus for splitting large rocks and concrete slabs that will eliminate the need for large liability insurance premiums, such as are necessitated by the use of dynamite.

An eighth object of the present invention is to provide apparatus for splitting large rocks and concrete slabs that can be used over and over again thereby cutting down the cost of such an operation.

A ninth object of the present invention is to provide an apparatus for splitting large rocks and concrete slabs which is simpler in both operation and structure than the apparatus of my above-mentioned copending application.

A feature of the present invention is the provision of apparatus to break rock and concrete slabs in situ when inserted into a predrilled hole in the rock and concrete slabs comprising first and second members each having an outer surface parallel to each other and a wall of the predrilled hole; a third member having a driven end, a free end, a first surface parallel to the outer surface of the first and second members slidably engaging a bottom surface of a longitudinal groove in the first member and a second surface opposite the first surface having a predetermined slope along a given length of the third member from a point adjacent to the driven end to the free end, the third member having a single inward stroke of a predetermined length during each cycle of operation; and a first arrangement disposed between the second surface of the third member and an inner surface of the second member, the first arrangement when rendered operative causing the outer surface of the first and second members to engage the wall of the predetermined hole and responding to the inward stroke of the third member to apply a powerful breaking force directly to the second member resulting in lateral movement thereof and to apply a reaction force equal to the breaking force to the first member to break the rock and concrete slabs surrounding the predrilled hole.

Another feature of the present invention is the provision of a dynamic increase in the power generated for breaking the rock and concrete slab by the use of wedging action which is achieved by the thickness of the third member decreasing by a predetermined amount at the free end thereof to provide the first predetermined slope along the given length.

Still another feature of the present invention is the provision of a housing which would protect the first, second and third members and the first arrangement from dust, dirt and the like; and a lubricant disposed in the housing to lubricate engaging surface of the first, second and third members and the members of the first arrangement.

A further feature of the present invention is the provision of a second arrangement in a cooperating relationship with the first arrangement to retain the first arrangement in an inoperative position and to enable rendering the first arrangement operative by enabling the first arrangement to move into an operative position.

Still a further feature of the present invention is the provision of a third arrangement disposed on the third member adjacent the driven end thereof in a cooperative relationship with the first arrangement to return the first arrangement to its inoperative position and to activate the second arrangement to retain the first arrangement to its inoperative position adjacent the end of each cycle of operation.

An additional feature of the present invention is the provision of the first arrangement including a fourth member having a first surface parallel to the outer surface of the first and second members and a second surface opposite the first surface slidably engaging the second surface of the third member, the second surface of the fourth member having a slope equal to but opposite the first predetermined slope; a fifth member having a first surface parallel to the outer surface of the first and second members slidably engaging the first surface of the fourth member and a second surface opposite the first surface having a second predetermined slope engaging the inner surface of the second member, the inner surface of the second member having a slope equal to but opposite the second predetermined slope, the fifth member responding to the inward stroke of the third member through the fourth member to apply the powerful breaking force to the second member and the reaction force to the first member when the fifth member is rendered operative and moved toward an operative position; and a spring acting longitudinally on the fifth member to urge the fifth member toward the operative position when the fifth member is rendered operative.

A further additional feature of the present invention is the provision of the second surface of the fifth member and the inner surface of the second member having engaging teeth thereon to assist in the resetting of the fifth member to its inoperative position at the end of each cycle of operation, the engaging teeth having a sloping surface with a slope equal to the first predetermined slope.

BRIEF DESCRIPTION OF THE DRAWINGS

Above-mentioned and other features and objects of the present invention will become more apparent by reference to the following description taken in conjunction with the accompanying drawing, in which.

DESCRIPTION OF THE PREFERRED EMBODIMENTS

Figure 1:
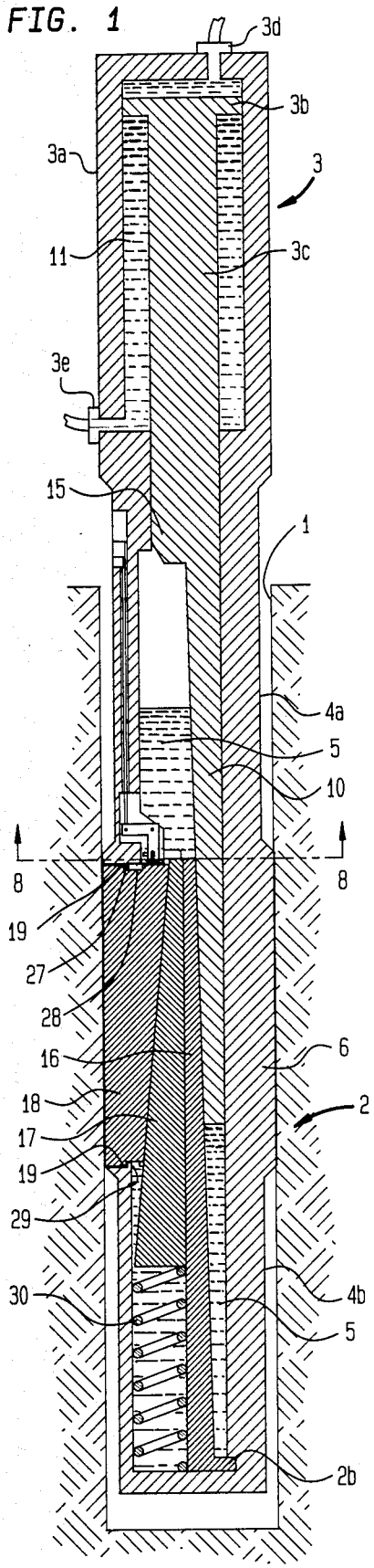
FIG. 1 is a cross-sectional view illustrating the components of the apparatus in accordance with the principles of the present invention in position within a predrilled hole in rock and/or in concrete slabs.

The rock breaking and concrete slab breaking mechanism of the present invention utilizes a mechanism capable of generating forces upper of 25 million psi (pounds per square inch) by using conventional hydraulic or pneumatic cylinders (fluid cylinders) as the power source. The apparatus of the present invention functions by insertion of the apparatus into a predrilled hole in the rock or concrete slab.

As mentioned hereinabove the prior art apparatus is able to generate forces of less than 1 million psi which is far below the forces needed to break granite and trap rock. The present invention makes possible a dynamic increase in the power generated by the use of wedging action of one surface of a power wedge having a relatively low profile where the thickness of the power wedge decreases by an amount equal to 0.03 inches to 0.08 inches at the free end thereof along a length of the power wedge equal to six to twelve inches. The slope of the single surface of the power wedge increases the mechanical advantage far beyond that which has been possible to date. The amount of "rise" or slope designed into the power wedge is a matter of individual application. It can vary to suit the strength of the rock to be broken.

As an example assume a "rise" of 0.062 inches over a ten inch length of the power wedge. This amounts to a mechanical advantage of 161.29. Assume that 30,000 pounds of force is generated in the hydraulic cylinder. This force would be translated into 4,838,709 pounds of force against the rock to be broken. ($161.29 \times 30{,}000 = 4{,}838{,}709$). Trap rock has the highest tensile strength (800 psi) and is the hardest rock to break. 4,838,709 pounds of force will break 42 square feet of trap rock. ($4{,}838{,}709 \div 800 = 6{,}048$ square inches $\div$ 144 inch $=$ 42 square feet).

Figure 2:
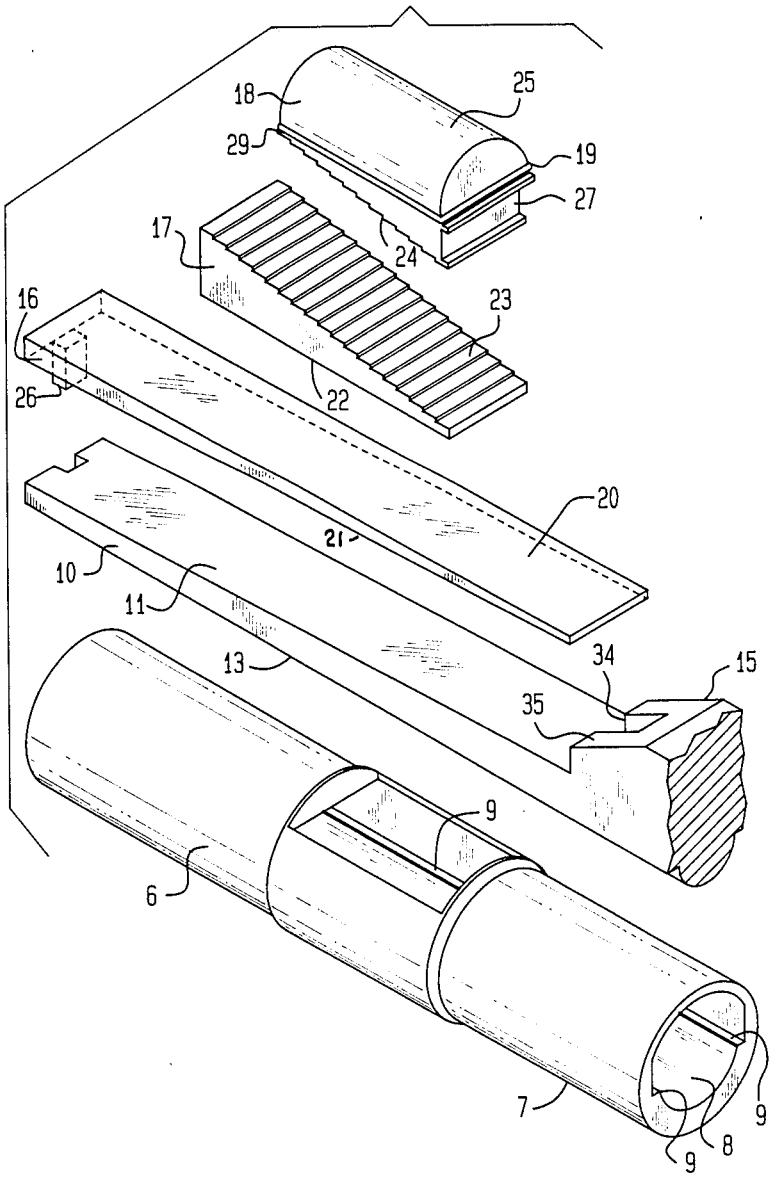
FIG. 2 is a perspective exploded view of the apparatus of FIG. 1.
Figure 8:
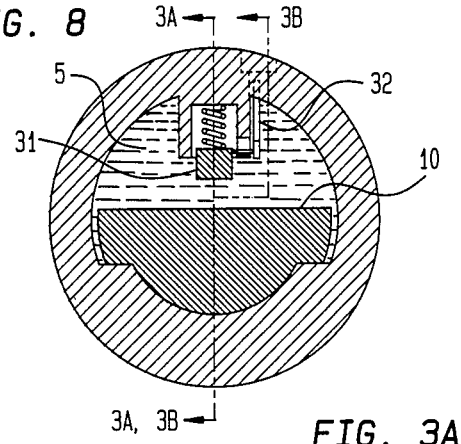
FIG. 8 is a cross-sectional view taken along line 8—8 of FIG. 1 to clarify how the cross-sectional views of FIGS. 3A, 3B and, BC are taken and with it being understood that the cross-sectional views of FIGS. 4A, 4B, 4C and 4D are taken in a similar manner.

Referring to FIGS. 1 and 2, the apparatus of the present invention, illustrated in a cross-sectional view in FIG. 1 and in a perspective exploded view in FIG. 2, is disposed in a predrilled hole 1 in rock or a concrete slab. The apparatus of the instant invention includes members all made of hardened steel. The rock buster 2 is operated by a fluid operated apparatus 3 with rock buster 2 under the influence of apparatus 3 expanding to crack the rock or concrete surrounding predrilled hole 1. An upper housing **4*a* and a lower housing 4*b* protect rock buster 2 from dirt, dust and the like and holds a lubricant 5, such as oil, that lubricates members of rock buster 2**.

As shown in FIG. 1 fluid (liquid or gas) operated apparatus 3 includes a cylinder **3*a* which is a continuation of upper housing 4*a* and a piston 3*b* which is connected to power wedge 10 by means of ram 3*c*. An inlet port 3*d* to cylinder 3*a* controls the power stroke of ram 3*c* and, hence, power wedge 10. An inlet port 3*e* to cylinder 3*a* controls the return or withdrawl stroke of ram 3*c* and, hence, power wedge 10** after each inward stroke which constitutes a single cycle of operation.

Because the apparatus of the present invention is a sealed unit the power or inward stroke of power wedge 10 causes a decrease in the volume of the lower oil reservoir in lower housing **4*b*** thereby driving oil through lubricating slots in the wedges and other members of rock buster 2 into the upper oil reservoir in upper housing 4*a*.

As can be seen in FIG. 1 apparatus of the present invention includes a fluid operated apparatus that is small enough to enter and operate within the full depth of the predrilled hole. This is not the case with respect to most of the known prior art devices, since most of the prior art devices require a fluid operated device, such as a jack hammer, which has a diameter greater than that of the predrilled hole 1. In operation, the apparatus or unit of the present invention can be inserted as a complete unit into predrilled hole 1 in stages or steps of progressive steps until the bottom of the predrilled hole is reached. At each step or stage of insertion the apparatus is activated to run through its cycle of operation to thereby crack or break the rock or concrete slab surrounding predrilled hole 1 at each progressive step or stage of depth in predrilled hole 1. This operation makes it easier and simpler to break or split rock to a greater depth in a single predrilled hole than can be accomplished in known prior art apparatus.

As can be seen best in FIG. 2, rock buster 2 includes a U shaped anvil 6. Anvil 6 has its outer surface 7 in contact with the rock wall of predrilled hole 1. The longitudinal groove 8 and ledges 9 are parallel to outer surface 7. The power wedge 10 which slides in groove 8 and on ledges 9 has a taper on one surface only thereof, namely, surface 11. For instance, power wedge 10 is twice as long as anvil 6 and the other wedges described hereinbelow. Surface 11 has a slope provided by decreasing the thickness of power wedge 10 gradually over a given length, for instance, six inches to ten inches, until the thickness of its free end is 0.030 inch to 0.080 inch. It should be noted that the active slope is half of the above amount, namely, 0.015 inch to 0.040 inch over a given length of three to five inches. Each stroke of power wedge 10 expands rock buster 2 by an amount equal to 0.015 inch to 0.040 inch. The power generated can be changed by changing the length of power wedge 10 and the slope of surface 11 of power wedge 10.

Surface 13 of power wedge 10 is parallel to surface 7 of anvil 6. Power wedge 10 is thrust by apparatus 3 with a single inward stroke a specific non-varying distance, or, in other words, has a predetermined stroke length. Formed on power wedge 10 adjacent the driven end thereof is a reset mechanism 15 which at the proper time in the operative cycle acts in concert with other mechanisms to reset rock buster 2. The proper time for the reset mechanism to be activated is toward the end of the single inward stroke of power wedge 10. Power wedge 10 has formed therein grooves, not shown, to enable the lubrication thereof by lubricant 5. Power wedge 10 is the member which generates a powerful breaking force to be applied to rock or concrete slab in the wall of predrilled hole 1.

As can be seen in FIG. 1 anvil 6 is actually a part of the housing formed by housing sections 4*a* and 4*b*. In other words anvil 6 is a portion of the housing enclosing rock buster 2 to prevent dust, dirt and the like from infiltrating the members of rock buster 2.

The other members of rock buster 2 include a separator plate 16, a snugger wedge 17 and the cracker bar 18. Cracker bar 18 is movable laterally with respect to housing sections 4*a* and 4*b* and is sealed thereto by an O-ring 19.

Separator plate 16 has a first surface 20 parallel to outer surface 7 of anvil 6 and a second surface 21 having the same but opposite slope as surface 11 of power wedge 10. Separator plate 16 separates power wedge 10 from snugger wedge 17 and is in a sliding engagement with surface 11 of power wedge 10. As power wedge 10 increases in thickness separator plate 16 transmits this power of power wedge 10 to snugger wedge 17 and, hence, to cracker bar 18.

Snugger wedge 17 has a first surface 22 parallel to outer surface 7 of anvil 6 which slidably engages surface 20 of separator plate 16 and a second surface 23 having a second predetermined slope engaging an inner surface 24 of cracker bar 18. Surface 23 of snugger wedge 17 has a predetermined slope which may be equal to or different than the slope of surface 11 of power wedge 10. Surface 24 of cracker bar 18 has the same but opposite slope as surface 23 of snugger wedge 17. The outer surface 25 of cracker bar 18 is parallel to outer surface 7 of anvil 6 and engages the wall of predrilled hole 1. Snugger wedge 17 transmits the power of power wedge 10 from separator plate 16 directly to cracker bar 18 and by a reaction force to anvil 6.

As mentioned hereinabove the cracking of the rock or concrete in the wall of predrilled hole 1 is accomplished by only one inward stroke of power wedge 10. The end of this single inward power stroke is utilized to return rock buster 2 to its inoperative or start position through the means of reset mechanism 15 on power wedge 10.

As noted in FIGS. 1 and 2 separator plate 16 has a projection 26 thereof which is retained in a indentation in housing 4*b* to retain separator plate 16 in its proper orientation with respect to the other members of rock buster 2. Cracker bar 18 includes therein a groove 27 which receives a projection 28 in upper housing 4*a* to permit lateral movement of cracker bar 18 but yet retains cracker bar 18 in its proper position relative to the other members of the apparatus. In concert with groove 27 and projection 28 cracker bar 18 has a projection 29 thereon which is in a cooperative relationship with lower housing 4*b* to retain cracker bar 18 in its proper relationship with the other members of the apparatus of the present invention.

Snugger wedge 17 is spring loaded longitudinally by spring 30 located in lower housing 4*b*. Thus, when snugger wedge 17 is placed into operation, spring 30 forces snugger wedge 17 toward fluid operating apparatus 3 thereby moving cracker bar 18 and anvil 6 into a snug fitting relationship with the wall of predrilled hole 1. Prior to the operation of snugger wedge 17, cracker bar 18 and anvil 6 are in a retracted state, that is, in a relationship with the wall of predrilled hole 1 so that there is space between these elements and the wall of predrilled hole 1 so that the apparatus can be inserted into predrilled hole 1.

Figure 3A:
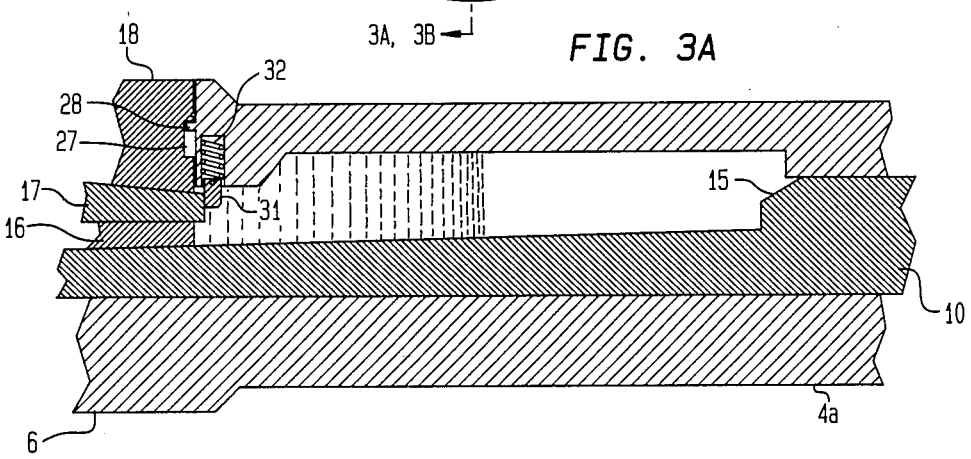
FIGS. 3A–3C are cross-sectional views illustrating in greater detail the operation controlling mechanism of the apparatus of FIG. 1.
Figure 3B:
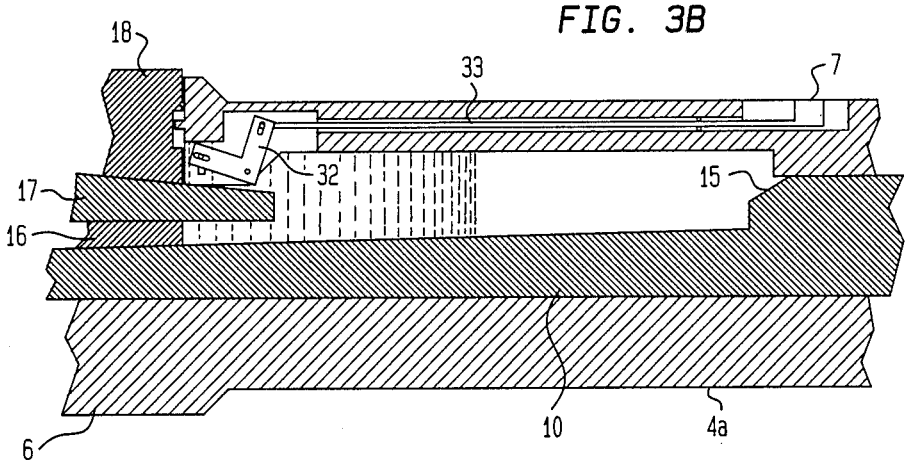
Figure 3C:
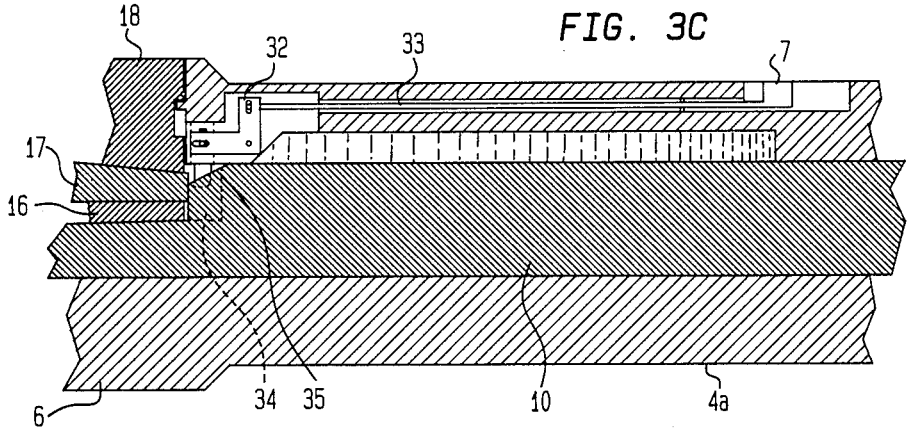
Figures 4A, 4B, 4C, 4D, 5, 6, 7:
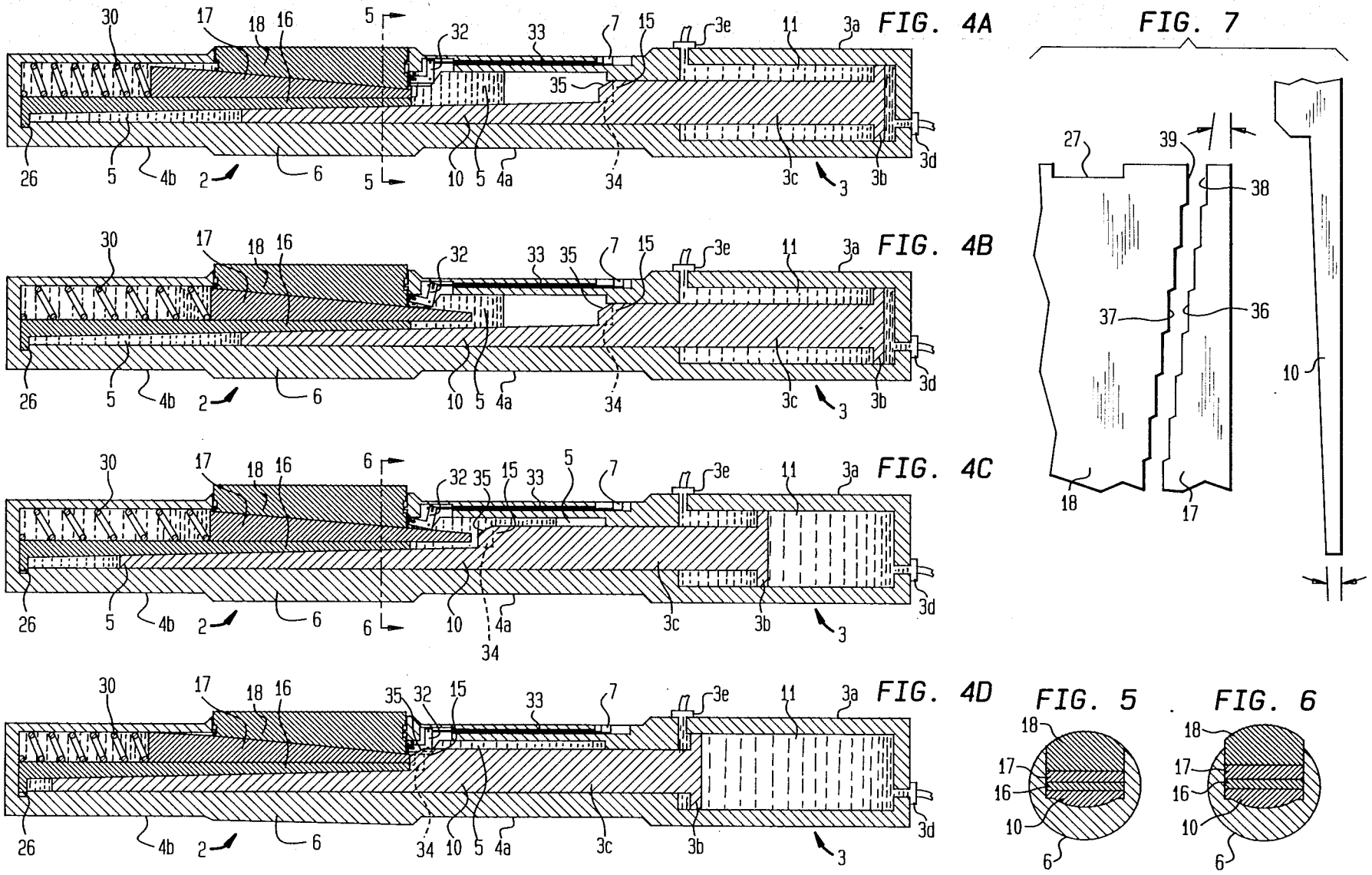
FIGS. 4A–4D are cross-sectional views of the apparatus of FIG. 1 illustrating the operation thereof in accordance with the principles of the present invention.
FIG. 5 is a cross-sectional view taken along line 5—5 of FIG. 4A.
FIG. 6 is a cross-sectional view taken along line 6—6 of FIG. 4C.
FIG. 7 is a side view of various members of the apparatus in accordance with the principles of the present invention showing in an enlarged view the low profile teeth in adjacent surfaces of members thereof and the relationship between the tapered surface of these teeth and the tapered surface of the power wedge.

Referring to FIGS. 3A–3C and FIGS. 4A–4D there is illustrated therein the apparatus employed in the apparatus of the present invention to start the operation of the rock busting apparatus of the present invention and to return the components of rock buster 2 to their initial inoperative or start position. The actuating apparatus includes a member 31 preloaded by spring 32 in the downward position so as to block the longitudinal movement of snugger wedge 17 thereby retaining the members of rock buster 2 in a collapsed or inoperative condition as shown in FIG. 5. As shown in FIGS. 3A and 4A power wedge 10 and piston 3*b* are in their fully retracted position which can be considered an inoperative position. When it is desired to start the operation of the apparatus in accordance with the principles of the present invention a linkage 32 and 33 is pulled to raise member 31 so as to free the end of snugger wedge 17 to enable movement thereof in a longitudinal direction toward the fluid actuating device 3. This action is shown in FIGS. 3B and 4B. Once snugger wedge 17 moves to expand cracker bar 18 to cause cracker bar 18 and anvil 6 to snugly fit against the walls of predrilled hole 1 power wedge 10 is actuated in its inward stroke. Toward the end of its inward stroke power wedge 10 abuts against the adjacent end of snugger wedge 17 as shown in FIG. 4C. At this point cracker bar 18 has been fully expanded as shown in FIG. 6 and applies the tremendous breaking force against the wall of predrilled hole 1. This is the point of maximum force applied to the rock or concrete in the wall of predrilled hole 1. As power piston 10 continues its inward stroke snugger wedge 17 is pushed back by reset mechanism 15 which includes a notch 34 and a sloping surface 35 which acts upon linkage 32 to return the linkages 32 and 33 to their inoperative position and to lower member 31 into a position that blocks the forward longitudinal movement of snugger wedge 17 and thereby holds snugger wedge 17 in its inoperative position as shown in FIGS. 3C and 4D. Member 31 can move to its blocking position because of notch 34 in reset mechanism 15.

The design of the low profile teeth 36 and 37 on members 17 and 18 is such as to provide a solid surface between these two members without slippage when pressure is applied. As shown in FIG. 7 the design of the low profile mating teeth is such as to provide tapered surfaces 38 and 39 so as to cancel out the lateral movement of cracker bar 18 during the final push of the inward stroke of power wedge 10. As a result, the full power of power wedge 10 is used not to break rock but rather to reset the apparatus to its start of inoperative position. When fluid device 3 returns to its start position the cycle is complete. It should be noted that the amount of taper or rise on power wedge 10 is equal to the amount of taper on the teeth 36 and 37 of snugger wedge 17 and cracker bar 18.

While I have described above the principles of my invention in connection with specific apparatus, it is to be clearly understood that this description is made only by way of example and not as a limitation to the scope of my invention as set forth in the objects thereof and in the accompanying claims.

I claim:

1. Apparatus to break rock and concrete slabs in situ when inserted into a predrilled hole in said rock and concrete slab comprising:

first and second members each having an outer surface and a longitudinal axis parallel to each other and a wall of said predrilled hole, said first member having a longitudinal groove therein, said groove including a bottom surface parallel to said longitudinal axes of said first and second members coextensive with said first member, a pair of spaced, outwardly extending ledge-like surfaces disposed as an extention of said bottom surface in a plane parallel to said longitudinal axes of said first and second members coextensive with said bottom surface and a pair of spaced vertical surfaces extending upward from the outer edges of said ledge-like surfaces and coextensive therewith;

a third member having a driven end, a free end, a first surface parallel to said longitudinal axes of said first and second members slidably engaging said bottom surface and said pair of ledge-like surfaces of said longitudinal groove in said first member and a second surface opposite said first surface having a first predetermined slope along a given length of said third member from a point adjacent to said driven end to said free end, said third member having a single inward stroke of a predetermined length during each cycle of operation; and first means disposed between said second surface of said third member and an inner surface of said second member slidably engaging said pair of vertical surfaces of said groove, said first means when rendered operative causing said outer surfaces of said first and second members to engage said wall of said predrilled hole and responding to said inward stroke of said third member to apply a powerful breaking force directly to said second member resulting in lateral movement thereof and to apply a reaction force equal to said breaking force to said first member to break said rock and concrete slabs surrounding said predrilled hole.

2. Apparatus according to claim 1, wherein the thickness of said third member decreases by a predetermined amount at said free end thereof to provide said first predetermined slope along said given length.

3. Apparatus according to claim 2, further including second means in a cooperating relationship with said first means to retain said first means in an inoperative position and to enable rendering said first means operative by enabling said first means to move into an operative position.

4. Apparatus according to claim 3, further including third means disposed on said third member adjacent said driven end thereof in a cooperative relationship with said first means to return said first means to said inoperative position and to activate said second means to retain said first means in said inoperative position adjacent the end of each cycle of operation.

5. Apparatus according to claim 4, further including a housing to protect said first, second and third members and said first, second and third means from dust, dirt and the like; and a lubricant disposed in said housing to lubricate engaging surfaces of said first, second and third members and members of said first means.

6. Apparatus according to claim 5, wherein said second means includes a spring-load member disposed to block movement of said first means into said operative position; and fourth means connected to said spring-loaded member operated at the start of each cycle of operation to move said spring-loaded member to unblock said first means to enable said first means to move into said operative position.

7. Apparatus according to claim 6, wherein said third means includes a raised portion on said third member adjacent said driven end thereof to abut said first means adjacent the end of each cycle of operation to push said first means to said inoperative position at the conclusion of said inward stroke and to enable said spring loaded member to block movement of said first member into said operative position at the conclusion of said inward stroke.

8. Apparatus according to claim 7, wherein said first member is a portion of said housing.

9. Apparatus according to claim 8, wherein said second member forms a portion of said housing but is laterally moveable with respect to said housing.

10. Apparatus according to claim 9, further including fluid actuated means connected to said driven end of said third member to provide said inward stroke for said third member.

11. Apparatus according to claim 2, wherein said first means includes a fourth member slidably engaging said pair of vertical surfaces having a first surface parallel to said longitudinal axes of said first and second members and a second surface opposite said first surface slidably engaging said second surface of said third member, said second surface of said fourth member having a slope equal to but opposite said first predetermined slope;

a fifth member slidably engaging said pair of vertical surfaces having a first surface parallel to said longitudinal axes of said first and second members slidably engaging said first surface of said fourth member and a second surface opposite said first surface having a second predetermined slope engaging said inner surface of said second member, said inner surface of said second member having a slope equal to but opposite said second predetermined slope, said fifth member responding to said inward stroke of said third member through said fourth member to apply said powerful breaking force to said second member and said reaction force to said first member when said fifth member is rendered operative and moved toward an operative position; and a spring acting longitudinally on said fifth member to urge said fifth member toward said operative position when said fifth member is rendered operative.

12. Apparatus according to claim 11, further including second means in a cooperating relationship with said fifth member to retain said fifth member in an inoperative position and to enable rendering said fifth member operative by enabling said spring to move said fifth member into said operative position.

13. Apparatus according to claim 12, further including third means disposed on said third member adjacent said driven end thereof in a cooperative relationship with said fifth member to return said fifth member to said inoperative position and to activate said second means to retain said fifth member in said inoperative position adjacent the end of each cycle of operation.

14. Apparatus according to claim 13, further including a housing to protect said first, second, third, fourth and fifth members and said second and third means from dust, dirt and the like; and a lubricant disposed in said housing to lubricate engaging surfaces of said first, second, third, fourth and fifth members.

15. Apparatus according to claim 14, wherein said second means includes a spring-loaded member disposed to block movement of said fifth member into said operative position; and fourth means connected to said spring-loaded member operated at the start of each cycle of operation to move said spring-loaded member to unblock said fifth member to enable said fifth member to move into said operative position.

16. Apparatus according to claim 15, wherein said third means includes a raised portion on said third member adjacent said driven end thereof to abut said fifth member adjacent the end of each cycle of operation to push said fifth member to said inoperative position at the conclusion of said inward stroke and to enable said spring loaded member to block movement of said fifth member into said operative position at the conclusion of said inward stroke.

17. Apparatus according to claim 16, wherein said first member is a portion of said housing.

18. Apparatus according to claim 17, wherein said second member forms a portion of said housing but is laterally moveable with respect to said housing.

19. Apparatus according to claim 18, wherein said second surface of said fifth member and said inner surface of said second member having engaging teeth thereon to assist in resetting said fifth member to said inoperative position at the end of each cycle of operation, said engaging teeth have a sloping surface with a slope equal to said first predetermined slope.

20. Apparatus according to claim 19, further including fluid actuated means connected to said driven end of said third member to provide said inward stroke for said third member.

* * * * *